US005214799A

United States Patent [19]

Fabry

[11] Patent Number: 5,214,799

[45] Date of Patent: Jun. 1, 1993

[54] PROTECTIVE GLOVE FOR THE PREVENTION OF CARPAL TUNNEL SYNDROME

[75] Inventor: John J. Fabry, Green Bay, Wis.

[73] Assignee: Fabry Glove and Mitten Co., Green Bay, Wis.

[21] Appl. No.: 721,136

[22] Filed: Jun. 26, 1991

[51] Int. Cl.[5] ..... A41D 19/00

[52] U.S. Cl. ..... 2/161 R; 2/20; 2/161 A

[58] Field of Search ..... 2/161 R, 161 A, 159, 2/20, 16, 160; 602/21

[56] References Cited

U.S. PATENT DOCUMENTS

| | | | |
|---|---|---|---|
| 2,077,202 | 4/1937 | Barrie | 2/20 X |
| 2,083,935 | 6/1937 | Arnold | 2/161 R |
| 4,329,741 | 5/1982 | Bach | 2/161 A |
| 4,531,241 | 7/1985 | Berger | 2/161 R |
| 4,561,122 | 12/1985 | Stanley et al. | 2/20 |
| 4,691,387 | 9/1987 | Lopez | 2/161 A |
| 4,700,405 | 10/1987 | Sternberg | 2/161 A X |
| 4,701,963 | 10/1987 | Overton | 2/161 A |
| 4,747,163 | 5/1988 | Dzierson | 2/161 A |
| 4,748,690 | 6/1988 | Webster | 2/20 X |
| 4,850,341 | 7/1989 | Fabry et al. | 2/161 R X |
| 5,070,856 | 12/1991 | Plummer | 2/161 A X |

OTHER PUBLICATIONS

Occupational Health and Safety, Sep. 1986, pp. 18, 20.

*Primary Examiner*—Clifford D. Crowder
*Assistant Examiner*—Sara M. Current
*Attorney, Agent, or Firm*—Foley & Lardner

[57] ABSTRACT

A glove for preventing carpal tunnel syndrome has palm-covering padding which protects the wearer's hand. The padding is made of a resilient flexible material such as foam rubber which is effective to provide protection from vibrations and shocks, and has a fold line extending diagonally across the palm to facilitate gripping the handle of an implement. This light-weight glove allows freedom for the fingers, wrist, and central folding of the hand, yet protects the palm of the hand from shocks which can cause carpal tunnel syndrome.

19 Claims, 1 Drawing Sheet

PROTECTIVE GLOVE FOR THE PREVENTION OF CARPAL TUNNEL SYNDROME

TECHNICAL FIELD

This invention relates to a padded, protective glove, particularly a glove for prevention of carpal tunnel syndrome in persons whose occupation requires extended use of a manual implement.

BACKGROUND OF THE INVENTION

Carpal tunnel syndrome is a well known, commonly occurring hand condition, sometimes referred to as median compression neuropathy within the carpal canal. The most common symptoms of this condition include intermittent pain and numbness of the hand. Such pain or numbness results from compression of the median nerve which extends from the wrist centrally into the palm of the hand between the palm heel and the ball of the thumb. In carpal tunnel syndrome, a dense fibrous tissue called the transverse carpal ligament forms over the median nerve and compresses it, producing the symptoms of pain and numbness.

Treatment of carpal tunnel syndrome varies according to the severity of the condition. Severe conditions usually require hand surgery to sever the transverse carpal ligament. For less severe cases, the use of a splint which immobilizes the wrist is sometimes effective, often in combination with an anti-inflammatory medication. Such treatments are generally expensive, painful, and may reduce the patient's ability to use the affected hand.

Carpal tunnel syndrome is a particular problem for workers in industries which require repeated manual operations with a held implement or tool. Carpal tunnel syndrome is a leading cause of workmen's compensation claims in many such industries.

Protective gloves have been proposed as one means of preventing carpal tunnel syndrome due to wrist flexing in *Occupational health and Safety, September,* 1986, *pages* 18, 20. A glove proposed for this purpose in the foregoing publication includes a tough pigskin shell wrapped around the wearer's wrist. This glove is heavy, cumbersome, and restricts free action of the wrist. Berger U.S. Pat. No. 4,531,241 issued Jul. 30, 1985 describes a glove having a pad which covers the palm, wrist and a portion of the forearm. This glove also restricts free action of the wrist.

Fabry et al., U.S. Pat. No. 4,850,341 issued Jul. 25, 1989, describes a glove with a tapered pad designed for use by meat cutters or others using an implement with an action similar to using a knife. While this glove is useful for some applications, its pad configuration is not convenient for other types of actions in which the palm bends, particularly across the central fold of the hand. A solid palm pad inhibits this action. The present invention addresses this problem by providing a protective glove which facilitates gripping and allows greater flexibility across the central fold of the palm.

SUMMARY OF THE INVENTION

A protective glove according to the invention includes a glove body having a front and back which define a rear wrist opening, finger openings and a thumb opening. A generally resilient, flexible padding is disposed on the glove front and substantially overlies the palm covering portion of the glove front. The padding has a fold line extending diagonally across the palm covering portion in the widthwise and rearward directions of the glove from a location between the thumb and forefinger to a location on the palm heel. The fold line preferably comprises a split in the padding which divides it into a pair of adjacent front and back pads. The padding material has a size and resilience suitable for protecting the hand from shocks which can result in carpal tunnel syndrome while allowing freedom of action.

BRIEF DESCRIPTION OF THE DRAWINGS

The invention will be described with reference to the appended drawing, wherein like numerals denote like elements, and.

DETAILED DESCRIPTION

Figure 1:
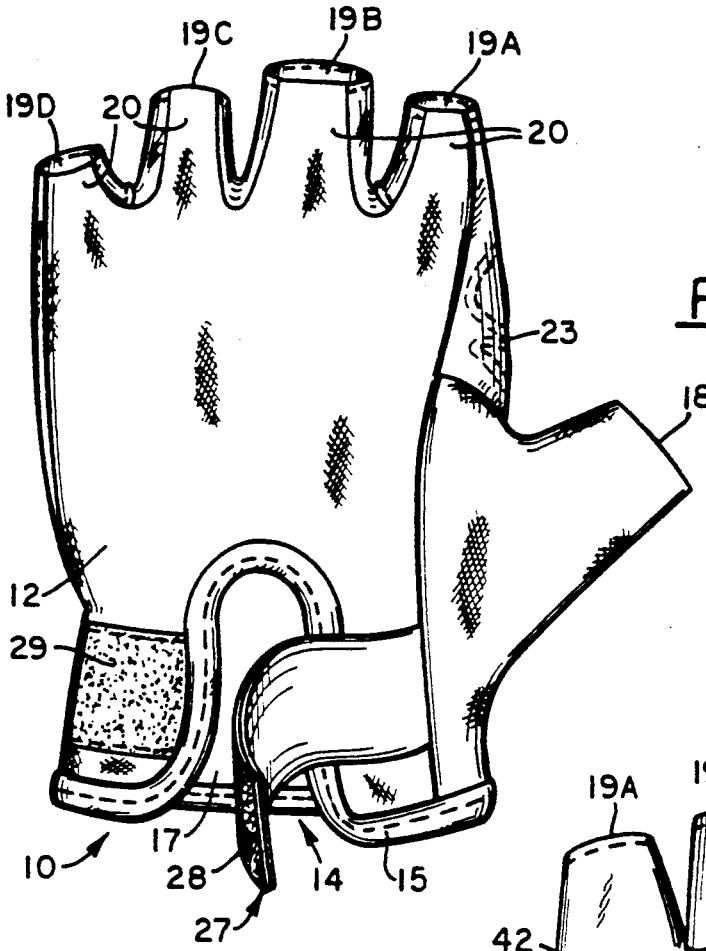
FIG. 1 is a rear plan view of a glove according to the invention.
Figure 3:
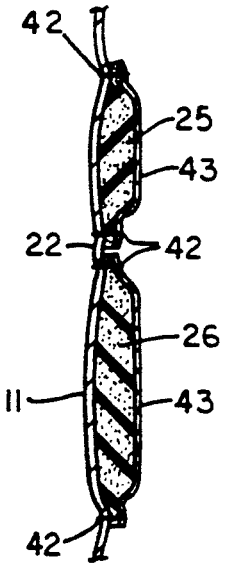
FIG. 3 is a sectional view of the glove of FIG. 2 taken along line 3—3 in FIG. 2.
Figure 2:
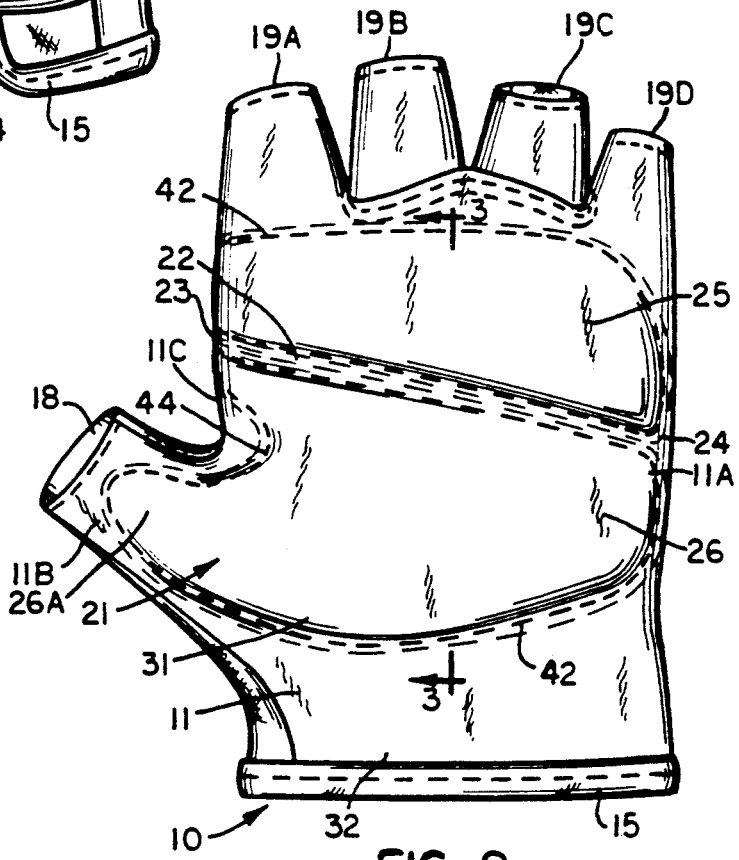
FIG. 2 is a front plan view of the glove shown in FIG. 1.

FIGS. 1 through 3 illustrate an exemplary glove 10 according to the invention for preventing or inhibiting carpal tunnel syndrome. Glove 10 generally comprises a glove front 11 and glove back 12 sewn together in a face-to-face relationship to define a glove body. Glove front 11 and back 12 are configured and sewn together so as to define a rearwardly opening wrist opening 14, a plurality of forwardly opening half-fingers 20 terminating in finger openings 19A, 19B, 19C, 19D for the forefinger, middle finger, ring finger and pinkie, respectively, and a side thumb opening 18. Front 11 includes a palm heel portion 11A, a half-thumb 11B, a palm covering portion 11C which overlies most or all of the wearer's palm, and a wrist cuff 15 which adjoins wearer's wrist. Glove front 11 is preferably made of a pliable, sturdy material such as leather. Glove back 12 is preferably made of elastic to provide improved fit.

Wrist opening 14 has a U-shaped, lengthwise vent 17 in the center of glove back 12. A releasable contact fastener 27 located on back 12 near cuff 15 acts as a means for selectively releasably securing glove 10 to the wearer's hand. Fastener 27 includes a tab 28 and a base element 29 secured to glove back 12 on either side of back vent 17. Base element 29 comprises a piece of hook tape sewn to back 12, and the undersurface of tab 28 is made of fibrous pile material so that releasable fastener 27 comprises a typical hook and loop closure. Releasable fastener 27 could also be a snap, button, or similar fastener conventionally used on gloves.

A generally rectangular protective padding 21 is sewn to the inside of front 11 of glove 10 substantially overlying palm covering portion 11C, including most of palm heel portion 11A and part of the front of thumb portion 11B. The center of padding 21 corresponds to the portion of front 11 which overlies the middle of the wearer's palm. In the illustrated embodiment, padding 21 has a fold line 22 therein which extends diagonally across palm covering portion 11C in the widthwise and rearward directions of front 11 from a first location 23 between thumb opening 18 and forefinger opening 19A to a second location 24 on palm heel portion 11A.

Fold line 22 preferably comprises a split in padding 21 which divides the padding into a pair of adjacent pad sections, i.e., a front pad 25 and back pad 26. Pad 25 has a rounded, generally rectangular shape. Pad 26 complements the shape of pad 25 along split 22, and has a rounded thumb pad portion 26A which extends at least half the length of thumb portion 11B and tapers towards thumb opening 18. Fold line 22 prevents the padding from bunching up when the wearer is gripping or holding an object.

As illustrated in FIG. 3, pads 25, 26 are sewn to glove front 11 along a seam 42 disposed around the outer periphery of padding 21 between front 11 and an elastic fabric lining 43. Lining 43 holds padding 21 in place and provides a good feel to the inside of glove 10.

Padding 21 must have sufficient firmness to protect the palm of the hand from shocks or vibrations, but should have sufficient flexibility to permit the wearer to effectively grasp and hold an object while wearing the glove. Padding 21 is thus preferably made of an elastomeric material, such as foam rubber, particularly materials such as closed-cell neoprene, ethylene propylene terpolymer (EPT), styrene butadiene (STB), and similar elastomers. The following table sets forth the preferred properties of materials for use as padding 21:

| Property | Preferred Minimum | Preferred Range |
|---|---|---|
| Compression Deflection in p.s.i. | 2 | 5-9 |
| Durometer (Shore 00) | 25 | 40-60 |
| Density in p.c.f. | 5 | 12-20 |
| Resilience* | 25 | 30-35 |

* Bashore % rebound average, 0.5 inch thickness at 72° F.

Preferred pad materials include Rubatex (trademark of Rubatex Corp., Bedford, Va.) R-421-N, R-422-N, R-425-N and Sorbothane (trademark of Sorbothane, Inc., Kent, Ohio).

Ordinary foam materials used as pads in conventional sporting gloves are generally too soft for use as padding 21. Thus, gloves for sports such as handball, wherein the palm is protected, are distinctly different from the glove 10 according to the present invention in both the size and shape of the protective pad and the characteristics of the pad. Padding 21 is most preferably made of a material having significant shock absorbing characteristics, so that shocks transmitted to the wrist by vibration or violent movements of the hand are dampened. The foregoing elastomeric materials are effective for this purpose.

Padding 21 has a preferred average width of at least about 7 cm, measured widthwise at its narrowest point (at thumb crease 44), typically in the range from about 7-12 cm, depending upon the size of the wearer's hand. Generally, the average width of padding 21 is at least as wide as wrist opening 14 when glove 10 is laid flat as illustrated in FIG. 2. The length of padding 21 from its rearwardmost edge to its forwardmost edge can vary considerably depending on both the size of the wearer's hand and the extent to which padding 21 overlies the wearer's palm. In general, the minimum or average length L of padding 21 should be at least about 6 cm, preferably about 6-10 cm. Overall, the minimum length and width of padding 21 are preferably about equal. Relative to the overall length of glove 10 from wrist cuff 15 to finger opening 19B, the length of padding 21 is typically from about 50-90% of the overall length of glove front 11, preferably 50-80% thereof.

The thickness of padding 21 is also important to providing sufficient protection for the hand. Thicknesses in the range of about 0.1 to 2 cm, particularly 0.5 to 1 cm, have been found advantageous because hand protection is provided without rendering the glove excessively bulky or inflexible.

Unlike the pad proposed in Fabry et al., U.S. Pat. No. 4,850,341, padding 21 need not adjoin wrist cuff 15. The curved bottom edge 31 of padding 21 (rear pad 26) is approximately aligned with thumb portion 11B, leaving a rear wrist portion 32 of front 11 free of padding to provide additional flexibility. In preferred embodiments, wrist portion 32 may have a minimum width as great as about 2 to 3 cm or more.

A glove 10 according to the foregoing embodiment of the invention is effective for protecting the wearer from repeated shocks and vibrations which may cause carpal tunnel syndrome. It is also light-weight, permits the wearer's wrist and fingers to move freely, and permits the palm to fold easily in a gripping action.

It will be understood that the foregoing description is of a preferred exemplary embodiment of the invention, and that the invention is not limited to the specific form shown. Modifications may be made in the design and arrangement of the elements without departing from the scope of the invention as expressed in the appended claims.

I claim:

1. A protective glove useful for prevention of carpal tunnel syndrome in the hand of a wearer who grasps and uses an implement with the hand on which the glove is worn, comprising:

a flexible glove body including a glove front and back defining therebetween a rear wrist opening, a wrist cuff surrounding said wrist opening, a palm heel portion, a thumb portion and a plurality of front finger portions including a forefinger portion, which finger portions are free of protective padding, said glove front further including a palm covering portion; and a generally resilient, flexible pad disposed on said glove front and substantially overlying said palm covering portion, said pad having a substantially straight fold line therein which extends diagonally across said palm covering portion in the widthwise and rearward directions of said glove from a first location at one edge of said pad between said thumb portion and said forefinger portion to a second location at the other edge of said pad on said palm heel portion, wherein said pad has a generally rectangular portion overlying said palm covering portion and a portion which extends from said palm covering portion about halfway onto said thumb portion.

2. The glove of claim 1, wherein said fold line comprises a split in said pad which divides said pad into a pair of adjacent, front and rear pads.

3. The glove of claim 2, further comprising means near said wrist cuff for releasably fastening said glove onto a hand.

4. The glove of claim 2, wherein said first location is located about halfway between said thumb portion and said forefinger portion, and said second location is located about halfway between said wrist cuff and a pinkie finger portion.

5. The glove of claim 1, wherein said finger portions are half-fingers terminating in finger openings, and wherein said thumb portion comprises a half-thumb.

6. The glove of claim 1, wherein said pad has a length between 50% and 90% of the length of said glove.

7. The glove of claim 1, wherein said pad is spaced from said wrist cuff, the bottom edge of said pad being substantially aligned with the bottom of said thumb portion.

8. A protective glove useful for prevention of carpal tunnel syndrome in the hand of a wearer who grasps and uses an implement with the hand on which the glove is worn, comprising:

a flexible glove body including a glove front and back defining therebetween a rear wrist opening, a wrist cuff surrounding said wrist opening, a palm heel portion, a thumb portion and a plurality of front finger portions including a forefinger portion, which finger portions are free of protective padding, said glove front further including a palm covering portion; and a generally resilient, flexible pad disposed on said glove front and substantially overlying said palm covering portion, said pad having a substantially straight fold line therein which extends diagonally across said palm covering portion in the widthwise and rearward directions of said glove from a first location at one edge of said pad between said thumb portion and said forefinger portion to a second location at the other edge of said pad on said palm heel portion, wherein said pad has a thickness of from about 0.2 to 2 cm and is made of an elastomeric material having a compression deflection of at least about 2 psi, a durometer of at least about 25, a density of at least 5 pounds per cubic foot, and a resilience of at least about 25% based on a Bashore percent rebound average for 0.5 inch thickness at 72° F.

9. The glove of claim 8, wherein said pad has a generally rectangular portion overlying said palm covering portion and a portion which extends from said palm covering portion about halfway onto said thumb portion.

10. The glove of claim 8, wherein said pad is made of a foam rubber material having a compression deflection of from about 5 to 9 psi, a durometer in the range of about 40 to 60, a density in the range of from 12 to 20 pounds per cubic foot, and a resilience in the range of 30 to 35% based on a Bashore percent rebound average for 0.5 inch thickness at 72° F.

11. The glove of claim 10, wherein said foam rubber is selected from the group consisting of neoprene, ethylene propylene terpolymer, styrene butadiene, and combinations thereof.

12. A protective glove useful for prevention of carpal tunnel syndrome in the hand of a wearer who grasps and uses an implement with the hand on which the glove is worn, comprising:

a flexible glove body including a glove front and back defining therebetween a rear wrist opening, a wrist cuff surrounding said wrist opening, a palm heel portion, a thumb portion and a plurality of front finger portions including a forefinger portion and a pinkie finger portion, said glove front including a palm covering portion; and a generally resilient, flexible padding disposed on said glove front and substantially overlying said palm covering portion, said pad having a substantially straight split in said pad which divides said pad into a pair of adjacent, front and rear pads and extends diagonally all the way across said palm covering portion in the widthwise and rearward directions of said glove from a first location at one edge of said palm covering portion between said thumb portion and said forefinger portion to a second location at the other edge of said palm covering portion on said palm heel portion, wherein said first location is about halfway between said thumb portion and said forefinger portion, and said second location is about halfway between said wrist cuff and said pinkie finger portion, and wherein said pad has a thickness of from about 0.2 to 2 cm and is made of an elastomeric material having a compression deflection of at least about 2 psi, a durometer of at least about 25, a density of at least 5 pounds per cubic foot, and a resilience of at least about 25% based on a Bashore percent rebound average for 0.5 inch thickness at 72° F.

13. The glove of claim 12, wherein the padding is sewn to the inside of the glove body between the glove body and an inner fabric lining.

14. The glove of claim 13, further comprising a fastener near said wrist cuff for releasably fastening said glove onto a hand, and wherein said finger portions comprise a plurality of half-fingers terminating in finger openings, which half-fingers are free of padding, and wherein said thumb portion comprises a half-thumb.

15. The glove of claim 14, wherein said front pad tapers widthwise towards said first location, and said rear pad has a first projection which extends about halfway onto said thumb portion and a second projection which extends to said first location, said projections defining a curved side therebetween such that a portion of the glove body at the juncture between the thumb portion and the palm covering portion near said curved side is free of padding.

16. The glove of claim 15, wherein the remainder of said glove body other than at said front and rear pads is free of padding.

17. The glove of claim 16, wherein said pad is spaced from said wrist cuff, the bottom edge of said pad being substantially aligned with the bottom of said thumb portion.

18. The glove of claim 12, wherein said pad is made of a foam rubber material having a compression deflection of from about 5 to 9 psi, a durometer in the range of about 40 to 60, a density in the range of from 12 to 20 pounds per cubic foot, and a resilience in the range of 30 to 35% based on a Bashore percent rebound average for 0.5 inch thickness at 72° F.

19. The glove of claim 18, wherein said foam rubber is selected from the group consisting of neoprene, ethylene propylene terpolymer, styrene butadiene, and combinations thereof.

* * * * *